US010058172B2

(12) United States Patent
Staib

(10) Patent No.: US 10,058,172 B2
(45) Date of Patent: Aug. 28, 2018

(54) SHELF SYSTEM

(71) Applicant: Wanzl Metallwarenfabrik GmbH, Leipheim (DE)

(72) Inventor: Ralph Staib, Leipheim (DE)

(73) Assignee: Wanzl Metallwarenfabrik GmbH, Leipheim (DE)

( * ) Notice: Subject to any disclaimer, the term of this patent is extended or adjusted under 35 U.S.C. 154(b) by 139 days.

(21) Appl. No.: 15/038,089

(22) PCT Filed: Nov. 20, 2014

(86) PCT No.: PCT/EP2014/075074
§ 371 (c)(1),
(2) Date: May 20, 2016

(87) PCT Pub. No.: WO2015/090821
PCT Pub. Date: Jun. 25, 2015

(65) Prior Publication Data

US 2016/0296010 A1 Oct. 13, 2016

(30) Foreign Application Priority Data

Dec. 16, 2013 (DE) ..... 10 2013 114 065

(51) Int. Cl.
*A47B 57/30* (2006.01)
*A47B 47/02* (2006.01)
(Continued)

(52) U.S. Cl.
CPC ..... *A47B 57/30* (2013.01); *A47B 47/027* (2013.01); *A47B 55/02* (2013.01); *A47B 96/061* (2013.01); *A47B 96/1441* (2013.01); *A47F 5/13* (2013.01)

(58) Field of Classification Search
CPC ... A47B 57/30; A47B 96/061; A47B 96/1441; A47B 55/02; A47B 47/027; A47F 5/13; A47F 5/132; A47F 5/135; A47F 5/137
See application file for complete search history.

(56) References Cited

U.S. PATENT DOCUMENTS 3,007,708 A * 11/1961 Ochs ..... A47B 55/02 108/107
3,659,722 A * 5/1972 Carroll ..... A01G 1/12 211/106
(Continued)

FOREIGN PATENT DOCUMENTS

DE 88 02 770 U1 4/1988
DE 90 01 635 U1 4/1990
(Continued)

OTHER PUBLICATIONS

International Search Report (PCT/ISA/210) dated Feb. 5, 2015, by the European Patent Office as the International Searching Authority for International Application No. PCT/EP2014/075074.
(Continued)

*Primary Examiner* — Stanton L Krycinski
(74) *Attorney, Agent, or Firm* — Buchanan Ingersoll & Rooney PC

(57) ABSTRACT

The invention relates to a shelf system comprising a rear wall, props, shelves that are arranged on the rear wall by means of brackets, and a base. The invention wherein each prop is formed by a vertical front column and a vertical rear column and in that the rear wall is stationarily arranged between the two columns.

21 Claims, 10 Drawing Sheets

Figure 1:
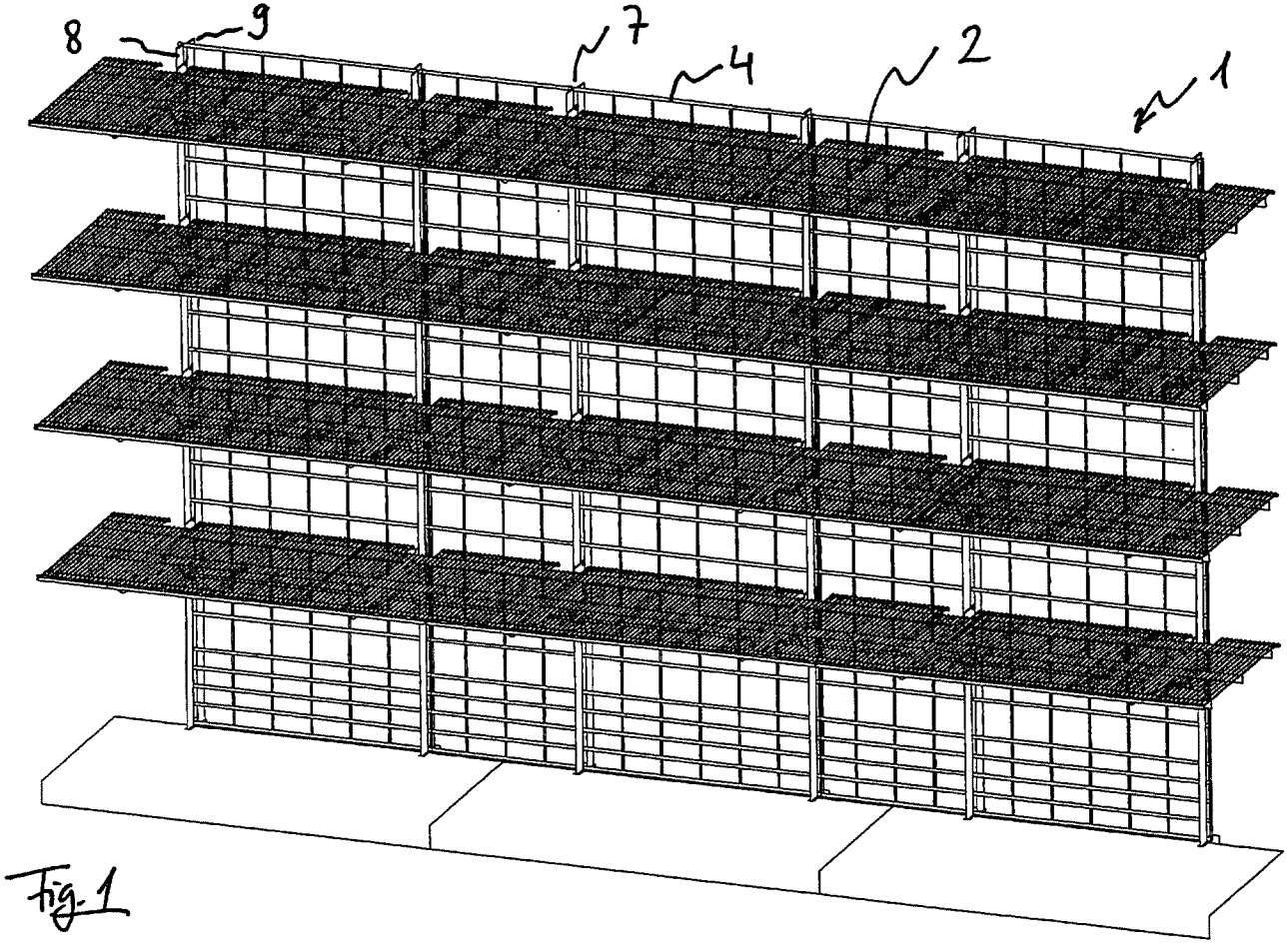

(51) Int. Cl.

| | |
|---|---|
| ***A47B 55/02*** | (2006.01) |
| ***A47B 96/06*** | (2006.01) |
| ***A47B 96/14*** | (2006.01) |
| ***A47F 5/13*** | (2006.01) |

(56) References Cited

U.S. PATENT DOCUMENTS

| | | | | | |
|---|---|---|---|---|---|
| 4,299,323 | A | | 11/1981 | Koch et al. | |
| 4,586,618 | A | * | 5/1986 | Norman | A47F 5/083 211/133.3 |
| 4,884,702 | A | * | 12/1989 | Rekow | A47F 5/083 211/106 |
| 5,255,803 | A | | 10/1993 | Pavone et al. | |
| 5,299,698 | A | | 4/1994 | Gay | |
| 5,482,168 | A | * | 1/1996 | Welch | A47B 96/00 211/106 |
| 5,588,543 | A | * | 12/1996 | Finger | A47F 5/083 211/106 |
| 5,769,248 | A | * | 6/1998 | Johnson | A47F 5/0807 211/103 |
| 5,855,283 | A | * | 1/1999 | Johnson | A47F 1/126 211/103 |
| 6,062,402 | A | * | 5/2000 | Ford | A47F 5/137 211/181.1 |
| 6,241,107 | B1 | * | 6/2001 | Boyer | A47F 5/137 211/106 |
| 6,299,001 | B1 | | 10/2001 | Frolov et al. | |
| 7,448,634 | B1 | * | 11/2008 | Raub | A47F 5/083 108/108 |
| 7,954,656 | B1 | * | 6/2011 | Cuzzocrea | A47F 5/103 211/189 |
| 8,016,137 | B2 | * | 9/2011 | Shaha | A47B 96/061 211/103 |
| 8,540,088 | B2 | * | 9/2013 | Brasher | A47F 5/083 211/106 |
| 9,271,584 | B1 | * | 3/2016 | Weinstein | A47F 5/135 |
| 2005/0279041 | A1 | * | 12/2005 | Staples | A47B 55/02 52/506.06 |
| 2006/0180557 | A1 | * | 8/2006 | Weinstein | A47B 55/02 211/40 |
| 2008/0067909 | A1 | * | 3/2008 | Hanson | A47B 96/061 312/408 |
| 2008/0116159 | A1 | | 5/2008 | Chu | |
| 2011/0192948 | A1 | * | 8/2011 | Chen | A47B 96/061 248/240 |
| 2014/0149242 | A1 | * | 5/2014 | Turner, Jr. | A47B 55/02 705/26.1 |

FOREIGN PATENT DOCUMENTS

| | | | | | |
|---|---|---|---|---|---|
| DE | 90 01 695 | U1 | | 4/1990 | |
| DE | 202010004220 | U1 | * | 8/2011 | A47B 55/02 |
| DE | 2392228 | A1 | * | 12/2011 | A47B 55/02 |
| EP | 0 616 500 | B1 | | 9/1994 | |
| FR | 1388576 | A | * | 2/1965 | A47B 55/02 |
| FR | 1441255 | A | * | 6/1966 | A47B 55/02 |
| FR | 1448239 | A | * | 8/1966 | A47B 47/025 |
| FR | 1478879 | A | * | 4/1967 | A47B 55/02 |
| FR | 2 636 824 | A1 | | 3/1990 | |
| GB | 731996 | A | | 6/1955 | |

OTHER PUBLICATIONS

Office Action dated Aug. 19, 2015, by the German Patent Office in corresponding German Patent Application No. 10 2013 114 065.3. (4 pages).

Office Action (Patent Examination Report No. 1) dated Sep. 7, 2016, by the Australian Patent Office in corresponding Australian Patent Application No. 2014365507 and Partial Translation (5 pages).

* cited by examiner

SHELF SYSTEM

The invention relates to a shelf system having the features in the preamble of the main claim.

Shelf systems are known from the prior art. One such is described, for example, in EP 0 616 500 B1. In this, the tiers are attached to stands by means of brackets. The stands in this case are of quite complex construction. They have three vertical rods which are connected with horizontal wires and a zigzag wire which impart stability to the system.

Further shelf systems formed from wire are disclosed e.g. in U.S. Ser. No. 42/993,237 A, GB 731996 A or alternatively U.S. Pat. No. 6,299,001 BA. These systems have a rear wall formed from horizontal and vertical wires. Tiers are attached to it. It is however difficult, if possible at all, to change the tiers. These systems also consist of numerous components, which makes the construction or a changed arrangement of the shelf system laborious.

The object of the present invention thus consists of improving the shelf systems known from the prior art and in so doing to develop the stands further in particular with the aim of arranging and also exchanging the tiers on the stands in a simple manner.

The invention achieves this object with the features in the main claim. Further advantageous embodiments are described in the dependent claims.

The arrangement of the stands, as vertical front and rear columns, arranged offset relative to one another or lying opposite one another, represents a simple and inexpensive but nevertheless stable construction.

The brackets can be mounted simply on the horizontal wires of the rear wall, and in particular also exchangeably.

The foot, which is likewise arranged on the horizontal wires of the rear wall, is likewise also arranged by mounting on the wires of the rear wall. Further, this imparts stability to the shelf system.

The assembly time can be shortened due to the simple construction of the present shelf system. This is in particular also advantageous when the shelf system is to be changed, as is frequently the case e.g. in a self-service store, if the goods on offer are to be changed.

Furthermore, the shelf system can be put together and also subsequently altered with any number of the individual elements whatsoever according to requirements. In addition, the shelf system is simple to dismantle and therefore can also be transported in a space-saving manner.

The width of the individual structural elements is arbitrary, so that the shelf system can be dimensioned to correspond to the space available.

The invention will be explained in greater detail with reference to an example of embodiment.

Figure 2A:
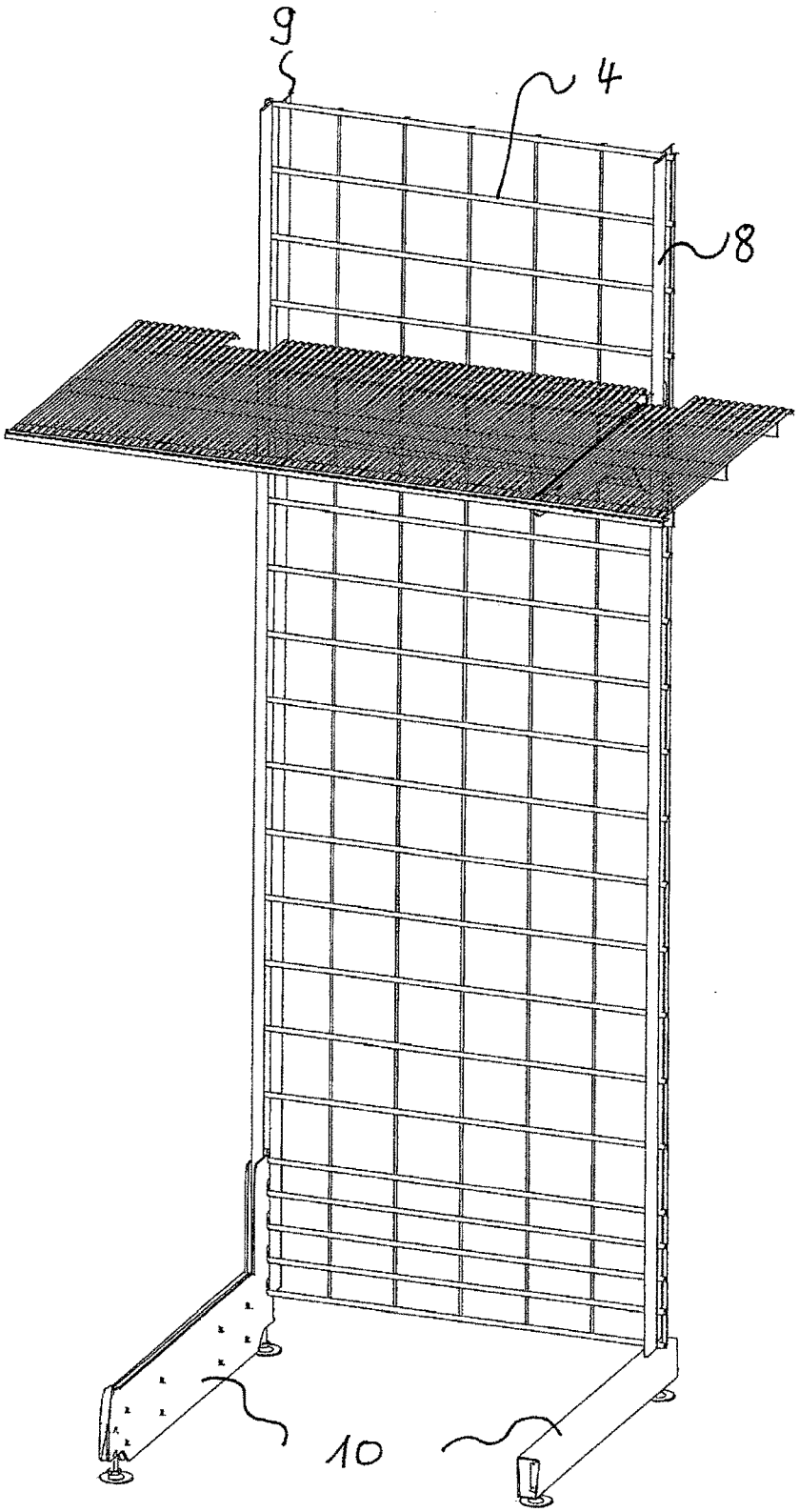
Figure 2B:
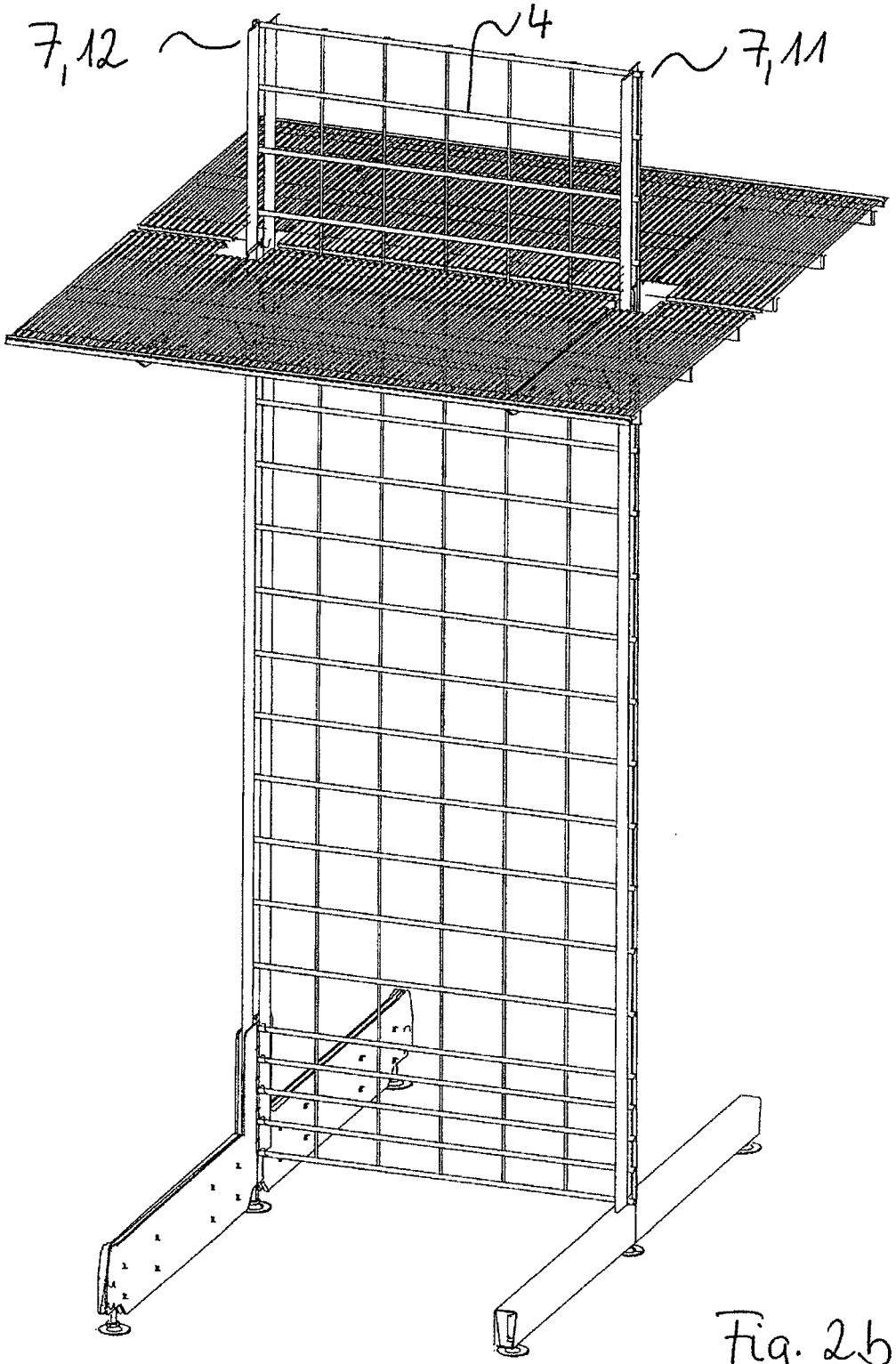
Figure 3A:
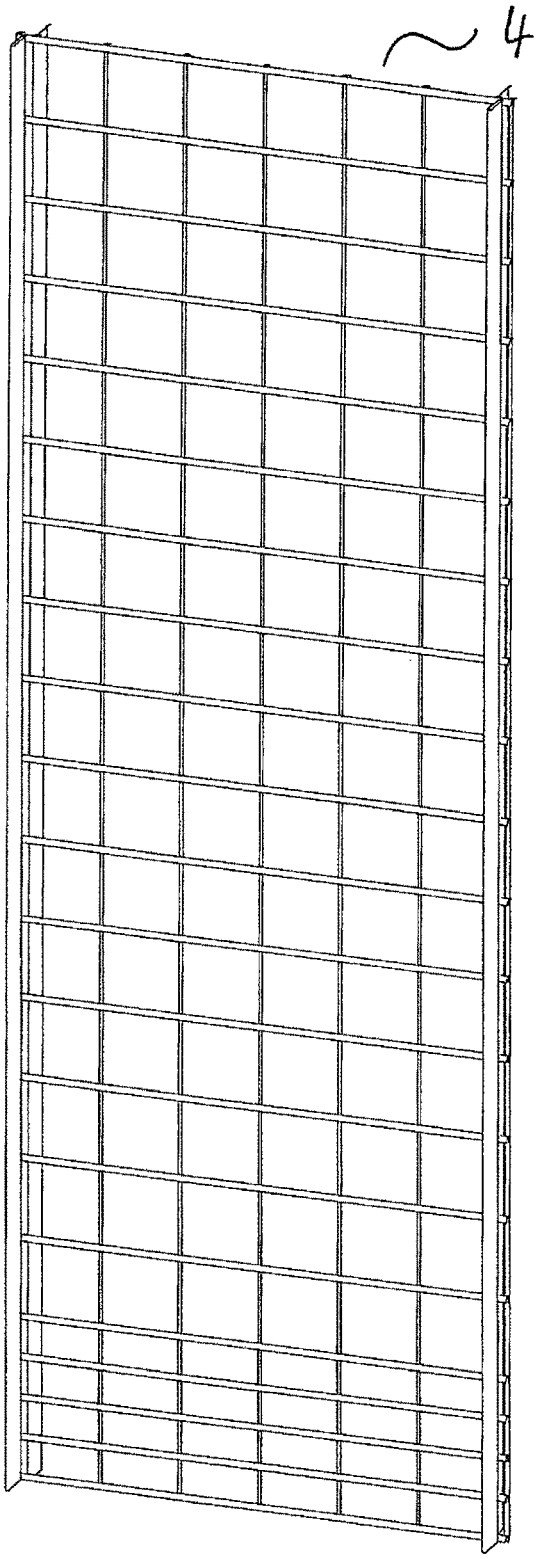
Figure 3B:
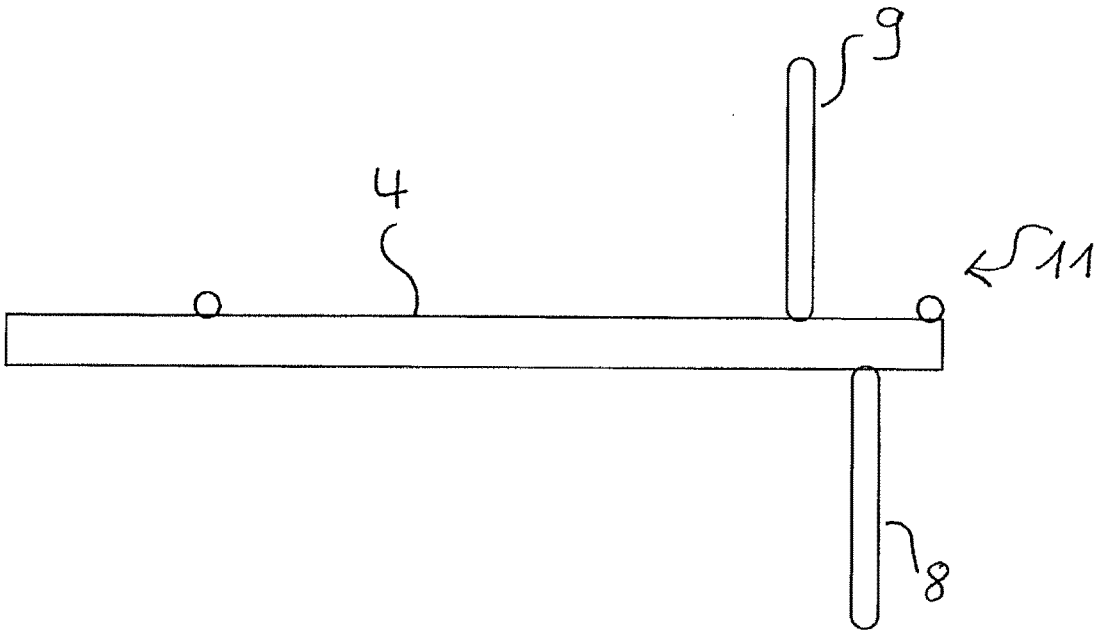
Figure 3C:
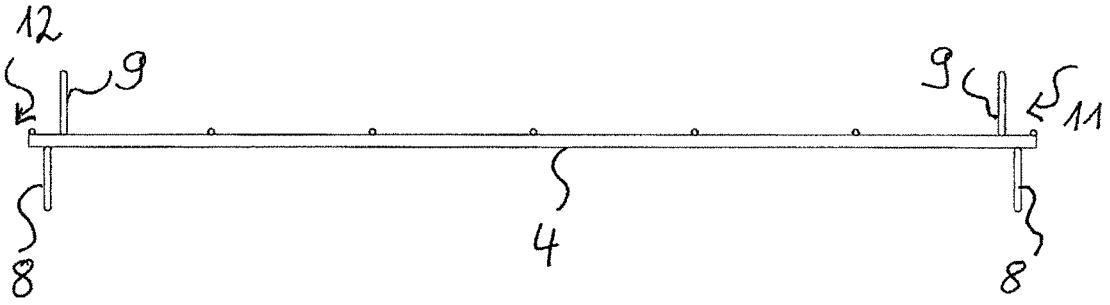
Figure 4A:
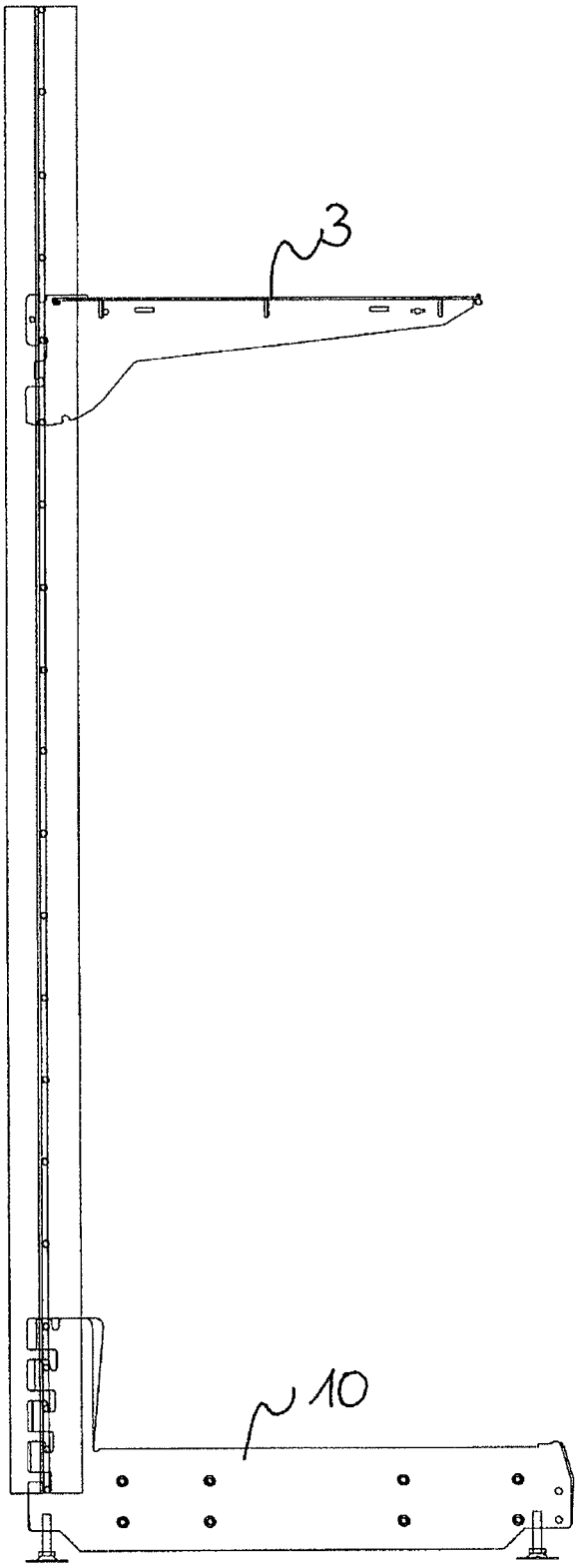
Figure 4B:
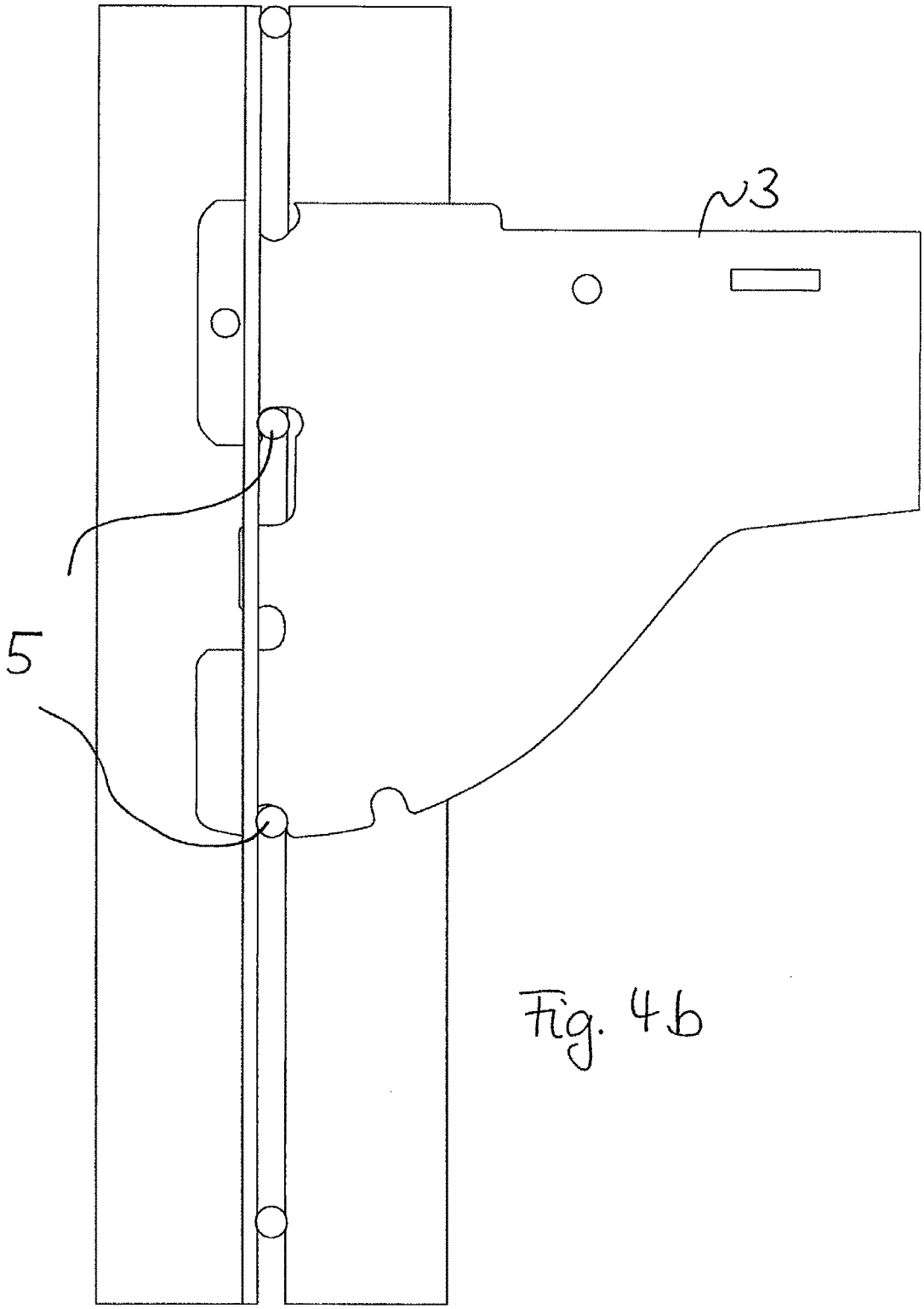
Figure 4C:
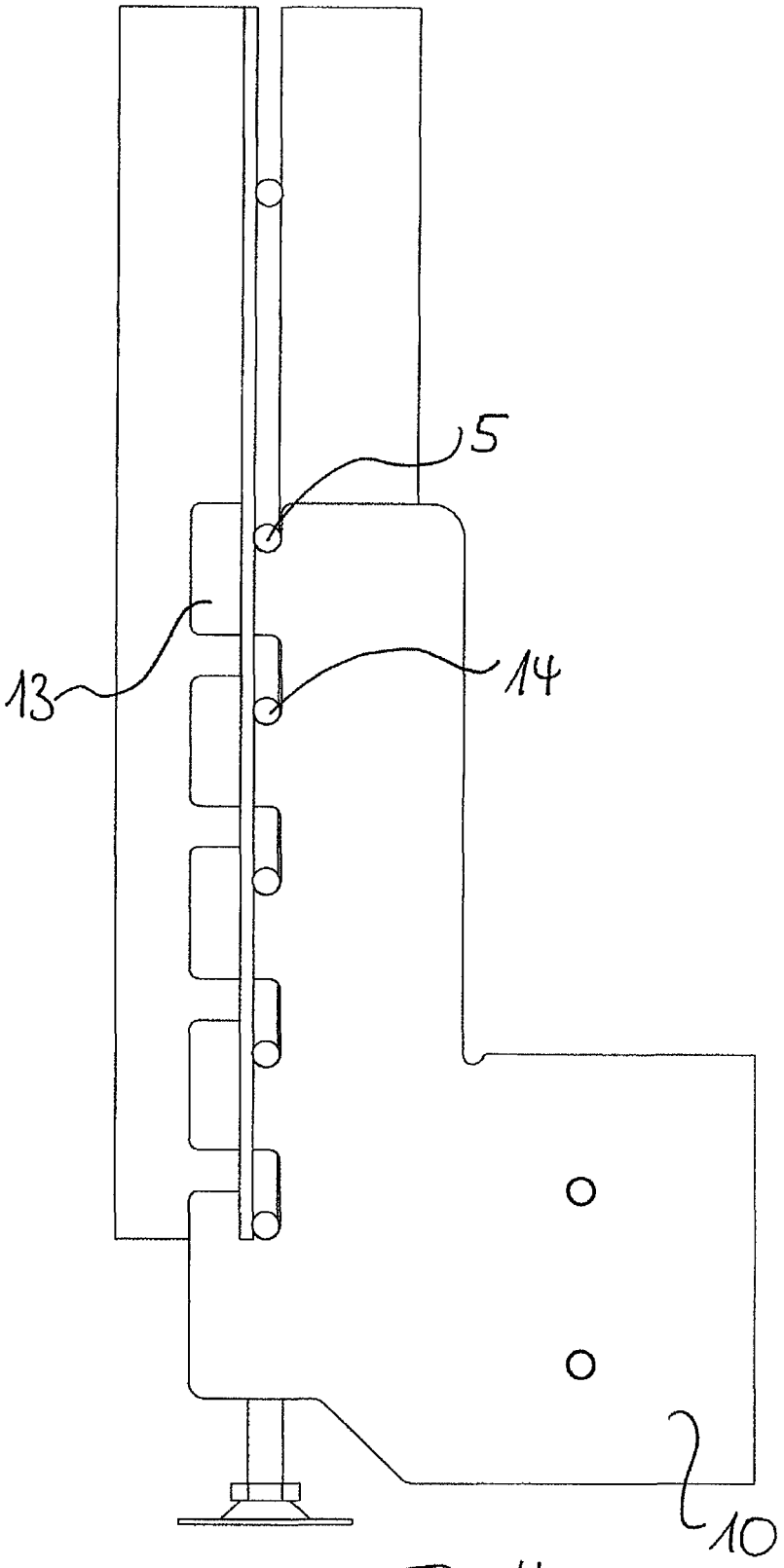
Figure 4D:
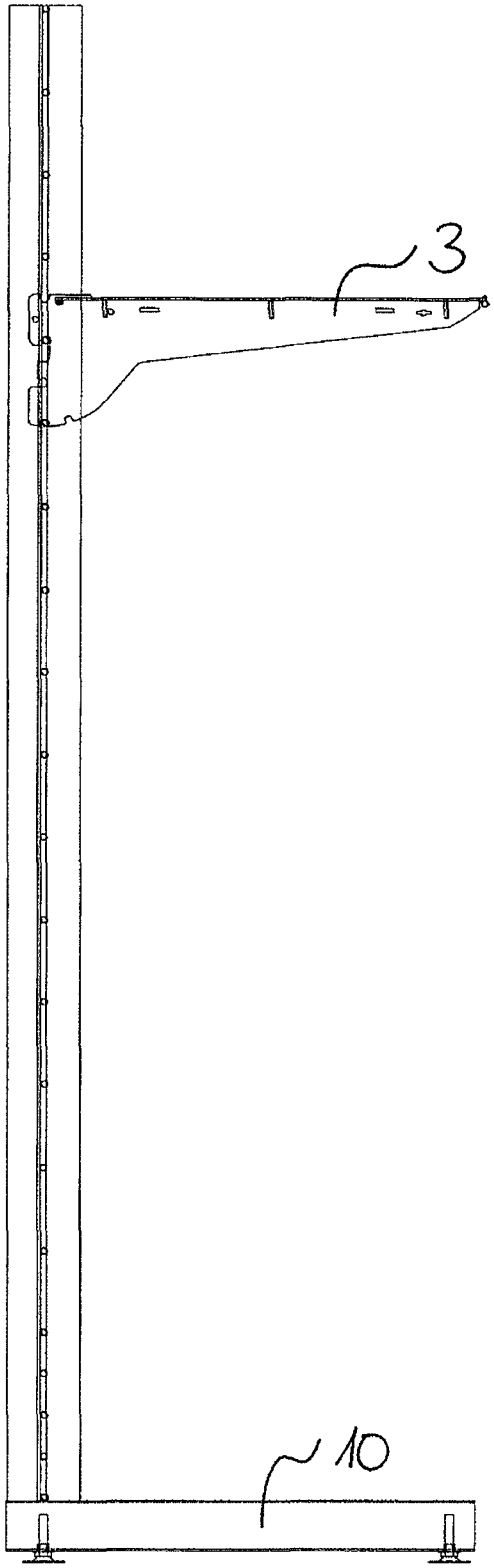

FIG. 1 shows a shelf system with a rear wall, in a perspective view,

FIG. 2*a* shows a rear wall with a tier in a perspective view,

FIG. 2*b* shows a rear wall with a different embodiment of a tier in a perspective view, FIG. 3*a* shows the rear wall in a perspective view, FIG. 3*b* shows a right-hand end region of the rear wall in a top view, FIG. 3*c* shows the rear wall in a top view, FIG. 4*a* shows the shelf system with a foot and a tier attached to a bracket in section, FIG. 4*b* shows the bracket, arranged on the rear wall, in detail, FIG. 4*c* shows the foot, arranged on the rear wall, in detail, FIG. 4*d* shows the shelf system with a foot and a tier attached to a bracket in a side view.

The invention describes a shelf system 1 with a rear wall 4, stands 7 and tiers 2, which are arranged on the rear wall 4 by means of brackets 3. In order to impart sufficient stability to the shelf system 1, feet 10 are provided.

The number of rear walls 4 is arbitrary. The width can also be designed according to requirements. FIG. 1 shows such a shelf system 1 with a rear wall 4. In the present case, four flats are arranged on tiers 2 on the rear walls 4: the number is arbitrary and can be changed at any time.

The stands 7 are formed from a front vertical column 8 and a rear vertical column 9. The rear wall 4 is arranged in fixed manner between the two columns 8, 9.

FIGS. 2*a, b* show a rear wall 4 with one tier 2 in each case. There is the possibility of arranging the tier 2 either only in one direction on the rear wall 4 (cf. FIG. 2*a*) or alternatively in two directions (cf. FIG. 2*b*).

The front vertical column 8 and the rear vertical column 9 are attached to the rear wall 4 offset relative to one another. In each case the bracket 3 is arranged on a horizontal wire 5 of the rear wall 4 between the two columns 8, 9.

Instead of a wire, also any other profile which is suitable for horizontal bracing can be used, would be conceivable e.g. a tube [sic].

In an alternative variant, not shown, the front vertical column 8 and the rear vertical column 9 are arranged lying opposite one another. The bracket 3 can then be mounted to the right or the left of the columns 8, 9.

One stand 7 in each case is provided on the right-hand and on the left-hand end region 11, 12 of the rear wall 4, which stand is formed from a front and a rear vertical column 8, 9. Thus one front and one rear vertical column 8, 9 in each case is provided both on the right-hand and on the left-hand end region 11, 12 of the rear wall 4.

In one alternative variant, one of the end regions 11, 12 may also be formed differently. For example, one of the end regions 11, 12 or both end regions 11, 12 does/do not have a stand 7. Rather, the stands 7 may also be arranged at a different position on the rear wall 4. It would be conceivable, for example, for the rear wall to have a length of 1,250 mm, but for the distance between the stands 7 to be only 600 mm. It should be taken into account that the distance between the stands 7 should be selected to be so great that the shelf system 1 has sufficient stability.

In the lower region of the rear wall 4, a foot 10 is arranged on the right-hand end region and on the left-hand end region 11, 12. FIGS. 2*a, b* in each case show two different types of feet 10, which are to be attached exchangeably in the lower region of the rear wall 4. These impart stability to the shelf system 1.

FIGS. 3*a, b, c* show the rear wall 4 in detail. In FIG. 3*a*, the rear wall 4 is illustrated in a perspective view.

FIG. 3*c* shows the rear wall 4 in a top view. The rear vertical columns 9 are arranged closer to one another than are the front vertical columns 8. It would however also be conceivable for the front vertical columns 8 to be arranged closer to one another than the rear vertical columns 9.

The columns 8, 9 are produced from a flat steel and are arranged, preferably welded, in fixed manner on the rear wall 4. The dimensions of the flat steel are arbitrary. It has proved useful for each vertical column 8, 9 to have a thickness of approximately 4 mm and a length of approximately 40 mm.

In one alternative variant, another profile is used. In this case, very widely-varying profiles would be conceivable.

The distance which is yielded between the columns 8, 9 of the right-hand or left-hand end region 11, 12 offers sufficient space for positioning a bracket 3.

The rear wall 4 is formed of horizontal and vertical wires 5, 6. A diameter of the vertical and horizontal wires 5, 6 of approximately 4 to 8 mm has proved advantageous. Other thicknesses are however also conceivable. The bracket 3 would then have to be adapted accordingly.

The wires 5, 6 of the rear wall 4 are likewise connected to one another in fixed manner. Spot welding is a suitable method.

The distance between the wires 5, 6 is arbitrary. A distance both between the horizontal wires 5 and between the vertical wires 6 of approximately 100 mm has proved advantageous.

In the lower region, as illustrated in FIG. 3*a*, a different distance between the last five horizontal wires 5 is provided. One suitable approach is to attach a foot 10 in this region, which foot is arranged on the horizontal wires 5. The distance between the horizontal wires 5 in the lower region of the rear wall 4 is less for this. A distance of approximately 50 mm has proved advantageous.

FIGS. 4*a* to *d* show the arrangement of the bracket 3 and foot 10 in detail. In FIGS. 4*a* and *c* a foot 10 is provided which is arranged on the five horizontal wires 5 in the lower region. The foot 10 has five holding means 13 which are provided with a cutout 14, so that the wire 5 can be introduced into the cutout 14 and furthermore can in addition be borne securely there. A number of five holding means 13 has proved useful, but a different number would also be conceivable.

FIG. 4*d* shows another embodiment of a foot 10. This too can be arranged exchangeably on the rear wall 4. In another embodiment, the foot 10 is connected to the stand 7 in fixed manner.

It has proved useful, as illustrated in FIG. 1, to protect the feet 10 with an enclosure. This enclosure, which is illustrated as a plinth tier, as illustrated in FIG. 1, may be formed e.g. from sheet metal, wire or wood.

Further, FIGS. 4*a, b* and *d* also show a bracket 3, partially with a shelf element, as is mounted on the rear wall 4. The bracket 3 in this case is embodied such that it is borne in two horizontal wires 5 of the rear wall 4. Furthermore, a radial cutout is provided on the upper side of the bracket 3. The bracket 3 can thus be introduced into the two horizontal wires 5 in a simple manner. Further, the bracket 3, as also emerges e.g. from FIG. 4*b*, may have a further radial cutout on the underside, so that the bracket 3 can be attached to the horizontal wires 5 of the rear wall 4 in an oblique position as well.

LIST OF REFERENCE NUMERALS

1 shelf system
2 tier
3 bracket
4 rear wall
5 horizontal wire
6 vertical wire
7 stand
8 front vertical column
9 rear vertical column
10 foot
11 right-hand end region (rear wall)
12 left-hand end region (rear wall)
13 holding means (foot)
14 cutout (foot)

The invention claimed is:

1. A shelf system configured to be supported on a floor, the shelf system comprising:

a rear wall formed from horizontal and vertical wires, horizontal tiers which are arranged on one or more of the horizontal wires of the rear wall by means of brackets, a plurality of feet, each of which is mounted directly to a plurality of the horizontal wires at a bottom of the rear wall, and a plurality of stands each formed from a front vertical column and a rear vertical column, and wherein the rear wall is arranged in a fixed manner between the front and rear vertical columns, wherein, when the shelf system is supported on the floor, only the plurality of feet contact the floor.

2. A shelf system according to claim 1, wherein the front vertical column and the rear vertical column are attached to the rear wall offset relative to one another.

3. A shelf system according to claim 1, wherein the front vertical column and the rear vertical column are arranged lying opposite one another.

4. A shelf system according to claim 1, wherein the front and rear vertical columns are fixed to the rear wall.

5. A shelf system according to claim 1, wherein one front and one rear vertical column in each case is provided both on a right-hand and on a left-hand end region of the rear wall.

6. A shelf system according to claim 5, wherein the rear vertical columns are arranged closer to one another than the front vertical columns.

7. A shelf system according to claim 1, wherein each vertical column is formed from a flat steel.

8. A shelf system according to claim 7, wherein each vertical column has a thickness of approximately 4 mm.

9. A shelf system according to claim 1, wherein the horizontal and vertical wires have a diameter of approximately 4 to 8 mm.

10. A shelf system according to claim 1, wherein adjacent ones of the horizontal wires are spaced from each other by a first predetermined distance at the bottom of the rear wall, and adjacent ones of the horizontal wires, other than the horizontal wires at the bottom of the rear wall, are spaced from each other at a distance that is greater than the first predetermined distance.

11. A shelf system, comprising:

a rear wall formed from horizontal and vertical wires, stands and tiers which are arranged on one or more of the horizontal wires of the rear wall by means of brackets, and wherein each of the stands is formed from a front vertical column and a rear vertical column, and wherein the rear wall is arranged in fixed manner between the front and rear vertical columns;

wherein a distance between the horizontal wires is less in a first region of the rear wall than a distance between the horizontal wires is in a second region of the rear wall, and the first region is lower than the second region;

the shelf system further includes feet mounted to the horizontal wires at the first region of the rear wall such that the rear wall is supported by the feet: and there are at least four horizontal wires in the first region.

12. A shelf system according to claim 1, wherein the distance between adjacent ones of the vertical wires is approximately 100 mm.

13. A shelf system according to claim 1, wherein the distance between adjacent ones of at least some of the horizontal wires is approximately 100 mm.

14. A shelf system according to claim 1, wherein each of the feet are attached to at least four of the horizontal wires.

15. A shelf system according to claim 1, wherein the distance between adjacent ones of at least some of the horizontal wires at the bottom of the rear wall is approximately 50 mm.

16. A shelf system according to claim 11, wherein the feet are mounted directly to the horizontal wires at the first region of the rear wall.

17. A shelf system according to claim 1, wherein each of the feet are attached to at least three of the horizontal wires.

18. A shelf system according to claim 1, wherein a distance between adjacent ones of the horizontal wires at the bottom of the rear wall is about one half a distance between adjacent ones of the horizontal wires in a region of the rear wall that is above the bottom of the rear wall.

19. A shelf system according to claim the 1, wherein each of the feet are attached to at least five of the horizontal wires.

20. A shelf system according to claim 7, wherein each vertical column formed from flat steel is arranged such that a flat surface of the column is perpendicular to the rear wall.

21. A shelf system according to claim 10, wherein the distance between adjacent ones of the horizontal wires at the bottom of the rear wall is approximately 50 mm.

* * * * *